United States Patent [19]

Brauer et al.

[11] 4,382,376

[45] May 10, 1983

[54] METHODS OF ROLLING WIRE RODS OR BARS

[75] Inventors: Hans Brauer, Leichlingen; Werner Demny, Dusseldorf, both of Fed. Rep. of Germany

[73] Assignee: Friedrich Kocks GmbH & Co., Hilden, Fed. Rep. of Germany

[21] Appl. No.: 308,136

[22] Filed: Oct. 2, 1981

Related U.S. Application Data

[63] Continuation of Ser. No. 100,349, Dec. 5, 1979, abandoned.

[30] Foreign Application Priority Data

Jan. 25, 1979 [DE] Fed. Rep. of Germany ..... 2902788

[51] Int. Cl.[3] ..... B21B 39/08

[52] U.S. Cl. ..... 72/205; 72/234; 72/366

[58] Field of Search ..... 72/199, 205, 234, 250, 72/365, 366

[56] References Cited

U.S. PATENT DOCUMENTS 3,693,393 9/1972 Nellen et al. ..... 72/250

*Primary Examiner*—Francis S. Husar
*Assistant Examiner*—Jonathan L. Scherer
*Attorney, Agent, or Firm*—Buell, Blenko, Ziesenheim & Beck

[57] ABSTRACT

In the reduction of the cross section of wire, rods or bars by rolling, the work material is placed under longitudinal compression in a roughing block and/or in an intermediate block and is only under tension in a finishing block. By this means, the ends of the work material are thinned prior to entry into the finishing block, instead of being thickened as they would be if the work material were under tension in the roughing and/or finishing block. Compensation for this end thinning is effected in the finishing block due to the rolling under tension, so that wastage due to cropped thickened ends is avoided.

5 Claims, 1 Drawing Figure

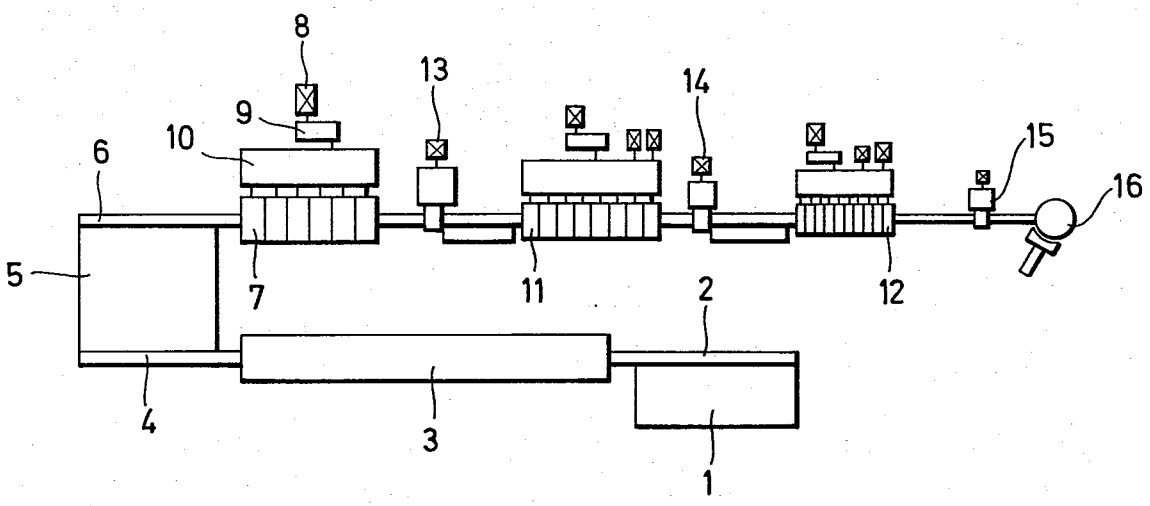
16
15
12
14
11
13
8
9
10
7
6
5
4
3
2
1

METHODS OF ROLLING WIRE RODS OR BARS

This is a continuation of application Ser. No. 100,349, filed Dec. 5, 1979, now abandoned.

This invention relates to methods of rolling wire, rods or bars and particularly to a method of rolling wire, rods or bars in which the cross section of the work material is reduced by at least one roughing and/or intermediate block before the work material enters a finishing block.

By far the largest quantity of wire or rods is produced by the above-mentioned method. The rotational speeds of the rolls of the individual stands in the various rolling blocks are then chosen such that an appreciable tensile force is always exerted upon the work material within the blocks between the rolling stands. The reason for this is to ensure that the work material runs through all the stands of the rolling line in a satisfactory and stable manner and to prevent sticking or jamming of the work material and also to prevent the work material from veering off laterally and forming loops at undesirable locations. Although the exertion of tension substantially avoids these disadvantageous phenomena, it gives rise to other disadvantages.

When rolling wire or rods in accordance with known methods under the action of tension in a longitudinal direction, extensive longitudinal portions having a larger cross sectional area than the central longitudinal portion of the wire or rod are formed at the leading and trailing ends of rolled wire or rod, and thin rib-like projections are frequently formed by material which has been squeezed into the gaps between the rollers at a given sizing pass. The two end portions having the larger cross sectional area have to be cropped off and they can only be used as scrap. These longitudinal portions called "thickened ends" are produced as a result of the method used for rolling the wire or rods. They are formed by virtue of the fact that, for example, the leading end portion is subjected to tension in a delayed manner and for a shorter period of time upon entry, namely, only when its leading end enters the second rolling stand. In contrast to this, the following longitudinal portions of the wire or bar are subjected to tension immediately after they have entered the first rolling stand, since the leading end portion has already been engaged by at least the second sizing pass. The same thing happens to the trailing end portion upon delivery from the rolling mill, this last end portion being relieved of tension when it has left the last sizing pass but one. Consequently, the leading and trailing end portions of each wire length or rod are not subjected to tension in the same manner as the central longitudinal portions, so that the thickened ends are unavoidably produced.

The thickened ends are relatively short in the first instance in the roughing line in which they are produced, but, owing to the considerable elongation of the work material, their length is increased to several meters downstream of the finishing block, thus resulting in a considerable loss when they are cropped. The loss of material is not avoided even when the thickened end portions are cropped downstream of the roughing line and, if required, downstream of the intermediate line, and, for the same reason, thickened ends which have to be cropped are also produced in the finishing line, even though these thickened ends are shorter.

An object of the invention is to provide a method of rolling wire or rods in which the thickened cropped end are substantially shortened or are largely avoided.

In accordance with the invention the cross section of the work material is reduced by rolling under longitudinal compression in at least one roughing and/or intermediate block before the work material enters and is rolled in a finishing block, the work material being rolled under longitudinal tension only in the finishing block.

As a result of this, no thickened ends, but possibly even thinned ends, are produced in the roughing and/or intermediate blocks, that is to say, where the work material is rolled under longitudinal compression. The reason for this is that, for example, the leading end portion of a wire or rod in the first instance enters the first sizing pass without being subjected to tension or compression, and that the compression only builds up after the wire or leading end of the rod has already passed through the second sizing pass. The cross section of the work material is enlarged only in the central longitudinal portion by the action of the longitudinal compression and the up-setting effect achieved thereby, whereas the leading end portion remains thinner. The same also applies analogously to the trailing end portion of the wire or rod at which, upon the delivery of the wire or rod from the rolling block, the action of the compression ceases at an earlier instant than in the region of the central longitudinal portion, so that the trailing end portions of the wires or rods are also thinner than the central longitudinal portions thereof.

The exertion of pressure in the longitudinal direction is generally possible in the region of the roughing and/or intermediate blocks owing to the fact that the cross section of the work material is still sufficiently large in this region and there is no risk of buckling or lateral veering off of the work material or jamming owing to the action of pressure in a longitudinal direction. When the thinned out ends of a wire or rod, which has been rolled in the roughing and/or intermediate blocks in a manner in accordance with the invention, then enter the finishing block, and the wire or rod is finished-rolled under tension in a conventional manner, the cross sectional areas are increased in the region of the leading and trailing end portions for the reasons mentioned initially, although these cross sectional areas do not lead to so-called thickened ends but serve only to compensate for the thinned ends previously obtained in the roughing and/or intermediate blocks. If the effective compression in the roughing and/or intermediate block and the effective tension in the finishing block are matched to one another, finished wire or finished bars can be obtained without any appreciable unserviceable end portions, thus constituting a considerable improvement which resides particularly in a considerable reduction in the amount of waste. Furthermore, the operational reliability of the entire rolling line is maintained, since the cross section of the work material is still sufficiently large to avoid disadvantages at the location where the rolling operation is performed under compression, whilst the rolling operation is performed, as hitherto, under tension in the region of the finishing block and thus in the region of the small cross section of the work material.

It can be advantageous if the work material is rolled under longitudinal compression only in individual regions of the roughing and/or intermediate blocks, preferably in the regions of the entry ends thereof. In this manner, the action of the compression can be reduced to the desired extent and can be adapted to the rolling program at any given time. Therefore, the work material is subjected to compression preferably in the front regions at the entry ends of the roughing and/or intermediate blocks, since this is the region where the larger cross section of the work material is located and consequently where there is the least risk of disadvantageous effects of subjecting the work material to longitudinal compression. It is advisable if the work material is rolled under longitudinal compression only down to a minimum cross sectional area of approximately 1200 mm.$^2$. This value relates to usual steels and is, of course, dependent upon the type of work material and the construction of the rolling block. Therefore, the limit specified above can be shifted upwardly or downwardly in a corresponding manner in the case of other materials.

The invention is further described, by way of example, with reference to the drawing which illustrates a plant by which the rolling method in accordance with the invention can be carried out.

Billets coming from a place of storage are unstacked at 1 and fed to a roller bed 2 which conveys the billets into a continuous-heating furnace 3. The billets leave the continuous-heating furnace 3 by way of a roller bed 4 from which they are conducted by means of a transfer skid 5 to a further roller bed 6 which is located in line with the rolling line of the actual wire rolling mill.

A six-stand roughing block 7 is driven by a motor 8 by way of reduction gear 9 and distribution gear 10 and is charged with the work material from the roller bed 6. An eight-stand intermediate block 11 is arranged in line with the roughing block 7, and a ten-stand finishing block 12 follows the intermediate block 11. The roughing block 7, and if desired, also rolling stands of the intermediate block 11, subject the work material to compression in the longitudinal direction during rolling, whilst the finishing block 12 operates under tension. Rotating shears 13 and 14 are provided between the blocks 7, 11 and 12 and primarily act as emergency shears in the event of a fault. A driver 15 and a pouring reeler 16 ensure that the finished-rolled wire is conveyed away in a satisfactory manner.

In the foregoing specification I have set out certain preferred practices and embodiments of my invention; however, it will be understood that this invention may be otherwise embodied within the scope of the following claims.

I claim:

1. A method of rolling wire, rods or bars in which the cross section of such work material is reduced by first rolling under longitudinal compression in at least one of a roughing and intermediate rolling mill block having at least two spaced roll stands continuously operating at different speeds such that the work is continuously longitudinally compressed during the time it is engaged in said roll stands and thereafter rolling the work material in a finishing rolling mill block, the work material being rolled under longitudinal tension only in the finishing block.

2. A method as claimed in claim 1 in which the work material is rolled under longitudinal compression only in individual regions of the roughing and intermediate blocks.

3. A method as claimed in claim 2 in which the work material is rolled under compression in the regions at the entry end of the roughing and intermediate block.

4. A method as claimed in claim 1, 2 or 3 in which the work material is rolled under longitudinal compression down to a minimum cross sectional area of approximately 1200 mm.$^2$.

5. A method of rolling wire, rods or bars as claimed in claim 1, 2 or 3 wherein the cross section of the work material is enlarged intermediate its ends between roll stands by action of the longitudinal compression while the ends are reduced in cross section to a cross section smaller than said intermediate portion during said longitudinal compression.

* * * * *